US007168356B2

(12) United States Patent
Rosene et al.

(10) Patent No.: US 7,168,356 B2
(45) Date of Patent: Jan. 30, 2007

(54) ADJUSTABLE LENGTH PUNCH ASSEMBLY

(75) Inventors: Ronald G. Rosene, Coon Rapids, MN (US); Glen M Shuldes, New Brighton, MN (US); Richard L. Timp, Vadnais Heights, MN (US); Wayne F. Peloquin, Forest Lake, MN (US); David M. Runk, St. Joseph, WI (US)

(73) Assignee: Wilson Tool International Inc., White Bear Lake, MN (US)

( * ) Notice: Subject to any disclaimer, the term of this patent is extended or adjusted under 35 U.S.C. 154(b) by 0 days.

(21) Appl. No.: 11/295,087

(22) Filed: Dec. 6, 2005

(65) Prior Publication Data

US 2006/0086230 A1 Apr. 27, 2006

Related U.S. Application Data

(63) Continuation of application No. 10/841,853, filed on May 7, 2004, now abandoned, which is a continuation of application No. 09/884,237, filed on Jun. 19, 2001, now Pat. No. 6,755,110.

(51) Int. Cl.
*B26F 1/14* (2006.01)
*A10H 5/02* (2006.01)

(52) U.S. Cl. ..... 83/686; 83/699.41; 83/698.91; 83/699.11; 83/552

(58) Field of Classification Search ..... 83/527, 83/699.41, 686.14, 698.91, 640, 129, 588, 83/686, 700, 684, 136, 699.61, 698.61, 698.71, 83/139–143, 138, 699.31, 530, 698.51
See application file for complete search history.

(56) References Cited

U.S. PATENT DOCUMENTS 3,563,124 A 2/1971 Gargrave
3,848,496 A 11/1974 Stevens et al.
3,926,082 A 12/1975 von Langendorff
3,935,771 A 2/1976 Cady, Jr.
3,937,113 A 2/1976 Pancook et al.

(Continued)

FOREIGN PATENT DOCUMENTS

EP 0 727 263 A1 8/1996

(Continued)

*Primary Examiner*—Boyer D. Ashley
*Assistant Examiner*—Ghassem Alie
(74) *Attorney, Agent, or Firm*—Fredrikson & Byron, P.A.

(57) ABSTRACT

Adjustable length punch assemblies are disclosed. An adjustable length punch assembly in accordance with present invention may be used with a punch press including a tool holder adapted to receive punch assembly and a ram adapted to move longitudinally along a ram axis. An adjustable length punch assembly in accordance with present invention preferably includes a punch body assembly disposed in threading engagement with a drive body assembly having a surface adapted to be struck by ram of punch press. The length of punch assembly may be adjusted by rotating of one body relative to other body. The adjustable length punch assembly preferably includes a lock mechanism for selectively preventing rotation of the punch body assembly relative to the drive body assembly. The lock mechanism preferably comprises a lock shaft coupled to one of bodies and a lock key slidingly coupled to other of bodies such that lock key slides along a lock key path. The lock key path is preferably disposed at an angle relative to ram axis when punch assembly is received by tool holder.

13 Claims, 5 Drawing Sheets

U.S. PATENT DOCUMENTS

| | | | | |
|---|---|---|---|---|
| 3,964,358 | A | 6/1976 | Stefano et al. | |
| 4,012,975 | A | 3/1977 | LaLone | |
| 4,031,787 | A | 6/1977 | Cady | |
| 4,141,264 | A | 2/1979 | Weisbeck | |
| 4,375,774 | A | 3/1983 | Wilson et al. | |
| 4,377,957 | A | 3/1983 | Wheeler | |
| 4,440,052 | A | 4/1984 | Weisbeck | |
| 4,989,484 | A | 2/1991 | Johnson et al. | |
| 5,020,407 | A | 6/1991 | Brinlee | |
| 5,054,347 | A | 10/1991 | Johnson et al. | |
| 5,056,392 | A | 10/1991 | Johnson et al. | |
| 5,081,891 | A | 1/1992 | Johnson et al. | |
| 5,131,303 | A * | 7/1992 | Wilson et al. | 83/140 |
| 5,195,413 | A | 3/1993 | Johnson | |
| 5,329,835 | A | 7/1994 | Timp et al. | |
| 5,647,256 | A * | 7/1997 | Schneider | 83/140 |
| 5,839,341 | A | 11/1998 | Johnson et al. | |
| 5,884,546 | A | 3/1999 | Johnson | |
| 6,047,621 | A | 4/2000 | Dries et al. | |
| 6,082,516 | A | 7/2000 | Willer | |
| 6,276,247 | B1 | 8/2001 | Helda | |
| 6,311,597 | B1 | 11/2001 | Schroth et al. | |
| 6,334,381 | B1 | 1/2002 | Chatham | |
| 6,463,839 | B2 | 10/2002 | Ohtsuka et al. | |
| 6,755,110 | B2 * | 6/2004 | Rosene et al. | 83/686 |
| 6,895,797 | B2 * | 5/2005 | Lowry et al. | 72/480 |

FOREIGN PATENT DOCUMENTS

| | | |
|---|---|---|
| JP | 11-254058 | 9/1999 |
| JP | 11-333531 | 12/1999 |
| JP | 2001-105053 | 4/2001 |

* cited by examiner

ADJUSTABLE LENGTH PUNCH ASSEMBLY

This is a Continuation of application Ser. No. 10/841,853 filed May 7, 2004, now abandoned which in turn is a continuation application of application Ser. No. 09/884,237 filed Jun. 19, 2001 (now U.S. Pat. No. 6,755,110).

FIELD OF THE INVENTION

The present invention relates generally to metal working tools. More particularly, the present invention relates to punch assemblies used in punch presses.

BACKGROUND OF THE INVENTION

Sheet metal may be economically fabricated into a wider range of useful products including chassis for appliances and electrical devices. Turret-type punch presses have found wide use in fabricating sheet metal. Turret-type punch presses employ an upper, generally cylindrical turret which holds a series of punch tools spaced circumferentially around its periphery, and a second, lower turret holding a series of dies circumferentially spaced about that turret's periphery, each turret being rotatable about a vertical axis to bring an appropriate punch and die pair into vertical alignment at a work station. By appropriately rotating the two turrets, an operator can bring a number of punches and dies sequentially into alignment at the work station to perform a series of sequential and different punching operations on a work piece.

Repeated use of a punch assembly in a punch press operation results in the natural dulling and wear of the punch tip. Once the tip has become dull, the effectiveness of the punch assembly is reduced and the punch tip must be sharpened. Sharpening may be accomplished by grinding the end of the punch tip, and this results in shortening the length of the punch. The length of the punch may then be adjusted to compensate for the ground-off portion.

The longitudinal axis of the punch assembly is typically placed in coaxial alignment with the axis of the ram. The ram of the punch press then strikes the punch with great force on it's impact surface.

SUMMARY OF THE INVENTION

The present invention relates generally to metal working tools. More particularly, the present invention relates to punch assemblies used in punch presses. An adjustable length punch assembly in accordance with the present invention may be used with a punch press including a tool holder adapted to receive the punch assembly and a ram adapted to move longitudinally along a ram axis. An adjustable length punch assembly in accordance with the present invention advantageously includes a punch body assembly disposed in threading engagement with a drive body assembly having a surface adapted to be struck by the ram of the punch press. The length of the punch assembly may be adjusted by the rotating of one body relative to the other body. The adjustable length punch assembly advantageously includes a lock mechanism for selectively preventing rotation of the punch body assembly relative to the drive body assembly. The lock mechanism advantageously features a lock shaft coupled to one of the bodies and a lock key slidingly coupled to the other of the bodies such that the lock key slides along a lock key path. The lock key path is advantageously disposed at an angle relative to the ram axis when the punch assembly is received by the tool holder.

In one implementation, the adjustable length punch assembly features a lock mechanism having a lock shaft coupled to one of the bodies and a lock key slidingly coupled to the other of the bodies such that the lock key slides along a lock key path. The lock key path may be advantageously disposed at an angle relative to a longitudinal axis of the punch assembly. When the punch assembly is received by the tool holder of a punch press, the lock key path is advantageously disposed at an angle relative to the ram axis of the punch press.

In some implementations of the present invention, the angle between the lock key path and the longitudinal axis of the punch body assembly is a right angle. In other implementations, the angle between the lock key path and the longitudinal axis of the punch body assembly is an acute angle. In some implantations, the lock key path is generally parallel to the striking surface of the drive body assembly.

In one aspect of the present invention, the lock key is moveable between a first position in which the lock key engages the lock shaft and a second position in which the lock key disengages the lock shaft. The adjustable length punch assembly may advantageously include a means for biasing the key toward the first position. In one implementation of the present invention, the means for biasing the key toward the first position comprises a spring having a first end seated against the lock key and a second end seated against one of the bodies.

In one aspect of the present invention, the lock shaft has a first axial degree of freedom relative to the lock key. In an advantageous implementation of the present invention, the first axial degree of freedom is generally parallel to the longitudinal axis of the punch assembly.

In one implementation of the present invention, the lock key includes an opening adapted to receive the lock shaft. The opening may be defined in part by a shaft engaging portion of the lock key. In some embodiments, the shaft engaging portion of the lock key advantageously includes at least one tooth. In other embodiments, the shaft engaging portion of the lock key advantageously includes at least one flat.

DETAILED DESCRIPTION OF THE PREFERRED EMBODIMENT

The following detailed description should be read with reference to the drawings, in which like elements in different drawings are numbered identically. The drawings, which are not necessarily to scale, depict selected embodiments and are not intended to limit the scope of the invention. Examples of constructions, materials, dimensions, and manufacturing processes are provided for selected elements. All other elements employ that which is known to those of skill in the field of the invention. Those skilled in the art will recognize that many of the examples provided have suitable alternatives that can be utilized.

Figure 1:
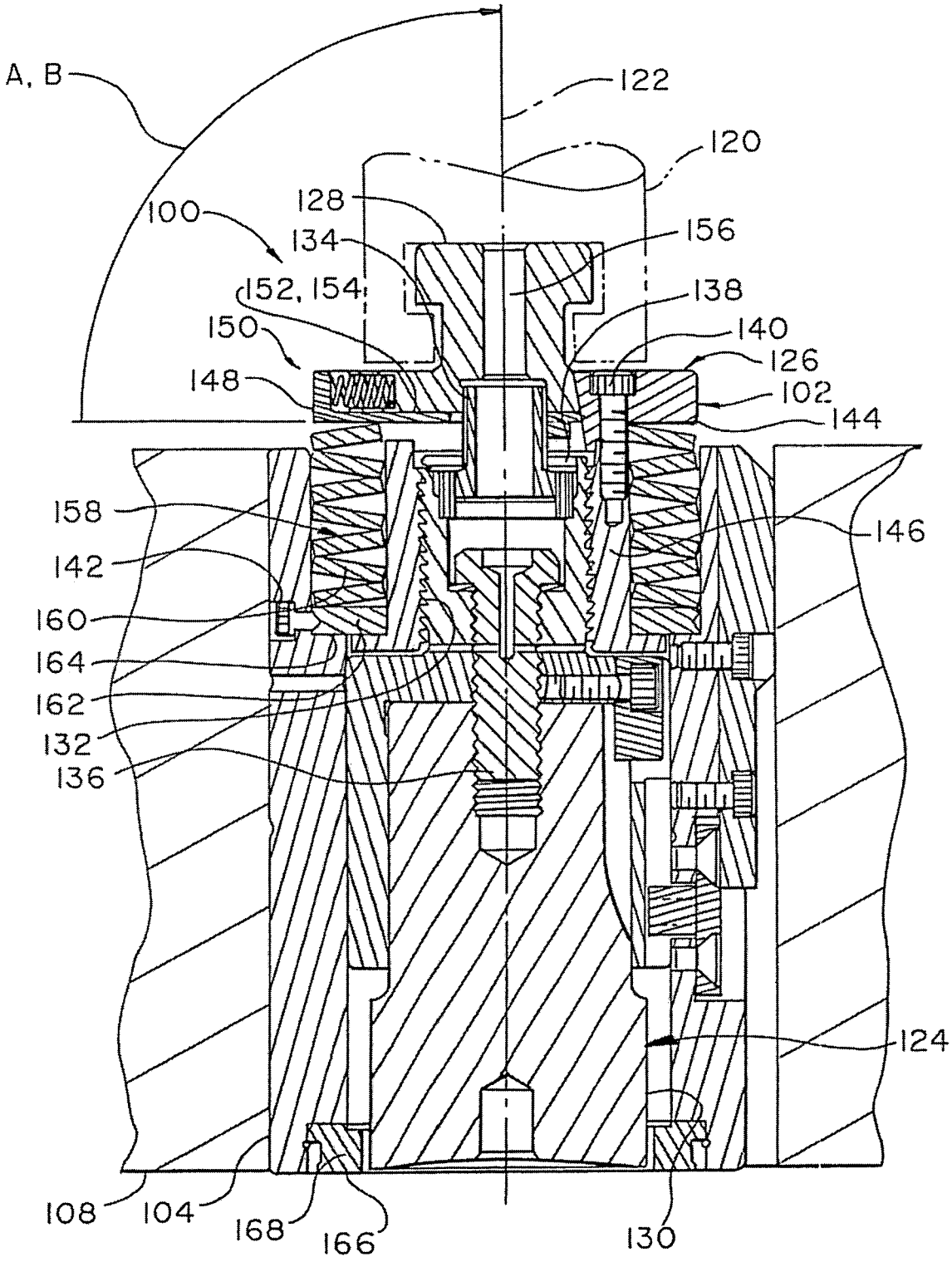
FIG. 1 is a cross sectional view of a punch set assembly in accordance with an exemplary embodiment of the present invention.

FIG. 1 is a cross sectional view of a punch set assembly 100 in accordance with an exemplary embodiment of the present invention. Punch set assembly 100 includes a sleeve 104 and an adjustable length punch assembly 102 that is slidingly disposed within sleeve 104. Punch set assembly 100 may be used in a punch press including a tool holder 108 adapted to receive sleeve 104 and a ram 120 adapted to move longitudinally along a ram axis 122.

In the embodiment of FIG. 1, adjustable length punch assembly 102 includes a punch body assembly 124 disposed in threading engagement with a drive body assembly 126 having a striking surface 128 adapted to be struck by ram 120 of the punch press. The length of adjustable length punch assembly 102 may be adjusted by rotating of punch body assembly 124 and drive body assembly 126 relative to one another.

Punch body assembly 124 comprises a punch blade 130, a male threaded member 132, and a lock shaft 134. As shown in FIG. 1, male threaded member 132 is attached to punch blade 130 by a relatively large cap screw 136 threaded axially into a threaded bore of punch blade 130. Also as shown in FIG. 1, lock shaft 134 is attached to male threaded member 132 with a plurality of pins 138 and a retaining ring.

Drive body assembly 126 of FIG. 1 comprises a drive cap 144 and a female threaded member 146. In the embodiment of FIG. 1, drive cap 144 is attached to female threaded member 146 by a plurality of cap screws 140, one of which is shown if FIG. 1. In FIG. 1 it may be appreciated that female threaded member 146 of drive body assembly 126 is disposed in threading contact with male threaded member 132 of punch body assembly 124.

As mentioned previously, the length of adjustable length punch assembly 102 may be adjusted by rotating of punch body assembly 124 and drive body assembly 126 relative to one another. In the embodiment of FIG. 1, adjustable length punch assembly 102 includes a lock mechanism 150 for selectively preventing rotation of punch body assembly 124 relative to drive body assembly 126. Lock mechanism 150 of FIG. 1 comprises lock shaft 134 of punch body assembly 124 and a lock key 148 that slidingly engages drive cap 144 of drive body assembly 126 such that lock key 148 slides along a lock key path 152.

In the embodiment of FIG. 1, the path taken by lock key 148 is defined in part by a guiding surface 154 of drive cap 144 of drive body assembly 126. In FIG. 1 it may be appreciated that, lock key path 152 is disposed at an angle A relative to a longitudinal axis 156 of adjustable length punch assembly 102. In FIG. 1 it may also be appreciated that lock key path 152 is disposed at an angle B relative to ram axis 122 of ram 120 when adjustable length punch assembly 102 is received by tool holder 108. In a preferred embodiment, adjustable length punch assembly 102 and ram 120 are disposed in a generally coaxial relationship during punching.

In the embodiment of FIG. 1, angle A between lock key path and longitudinal axis 156 and angle B between lock key path 152 and ram axis 122 are both right angles. Embodiments of the present invention are possible in which, angle A and angle B are acute angles or obtuse angles. In the embodiment of FIG. 1 it may be noted that, lock key path 152 is generally parallel to striking surface 128 of drive body assembly 126.

Lock shaft 134 preferably has a first axial degree of freedom relative to lock key 148. In the embodiment of FIG. 1, lock shaft 134 is free to move along longitudinal axis 156 reative to lock key 148. This axial degree of freedom allows adjustments to be made in the length of adjustable length punch assembly 102.

Punch set assembly 100 also includes a spring assembly 158 comprising a plurality of belleville washers 160. A first end of spring assembly 158 is seated against drive cap 144 of drive body assembly 126. A second end of spring assembly 158 is seated against a spring support ring 162. Spring support ring 162 is in turn seated against a ledge 164 of sleeve 104.

During a punching operation, ram 120 strikes downwardly on striking surface 128 of drive body assembly 126 compressing spring assembly 158 and urging adjustable length punch assembly 102 downwardly until punch blade 130 protrudes below a lower face 166 of a stripper plate 168 of punch set assembly 100. The protruding punch blade 130 passes through a workpiece (not shown) to punch an item out of the workpiece having the desired shape. Punch set assembly 100 may be adaptable to a variety of punch blade shapes and matching stripper plates depending upon the shape desire to be removed from the workpiece.

Ram 120 may then be retracted, releasing the compressive force on the spring assembly 158. The spring assembly 158 then may act to draw punch blade 130 upward. When punch blade 130 is retracted upwardly through stripper plate 168 its sides may engage the workpiece which often sticks to the retreating punch blade 130. Stripper plate 168 may engage the top face of the workpiece to assist in separating it from punch blade 130.

Repeated use of a punch blade in a punch press operation results in the natural dulling and wear of the punch blade. Once the punch blade has become dull, the effectiveness of the punch assembly is reduced and the punch blade must be sharpened. Sharpening may be accomplished by grinding the end of the punch tip, and this results in shortening the length of the punch blade. The length of the punch assembly may then be adjusted to compensate for the ground-off portion of the punch blade.

Generally, when sharpening of punch blade 130 is desired, the operator removes punch blade 130 from punch set assembly 100, for example by loosening large cap screw 136. Punch blade 130 may then be sharpened or replaced. After replacing or sharpening punch blade 130, appropriate changes in the overall length of adjustable length punch assembly 102 may be made by rotating punch body assembly 124 and drive body assembly 126 with respect to one another. Lock key 148 of lock mechanism 150 selectively engages lock shaft 134 to prevent inadvertent changes in the length of adjustable length punch assembly 102. The likelihood that changes in length will occur due to the force of ram 120 striking adjustable length punch assembly 102 is reduced when lock key path 152 of lock key 148 is disposed at an angle to ram axis 122.

Figure 2:
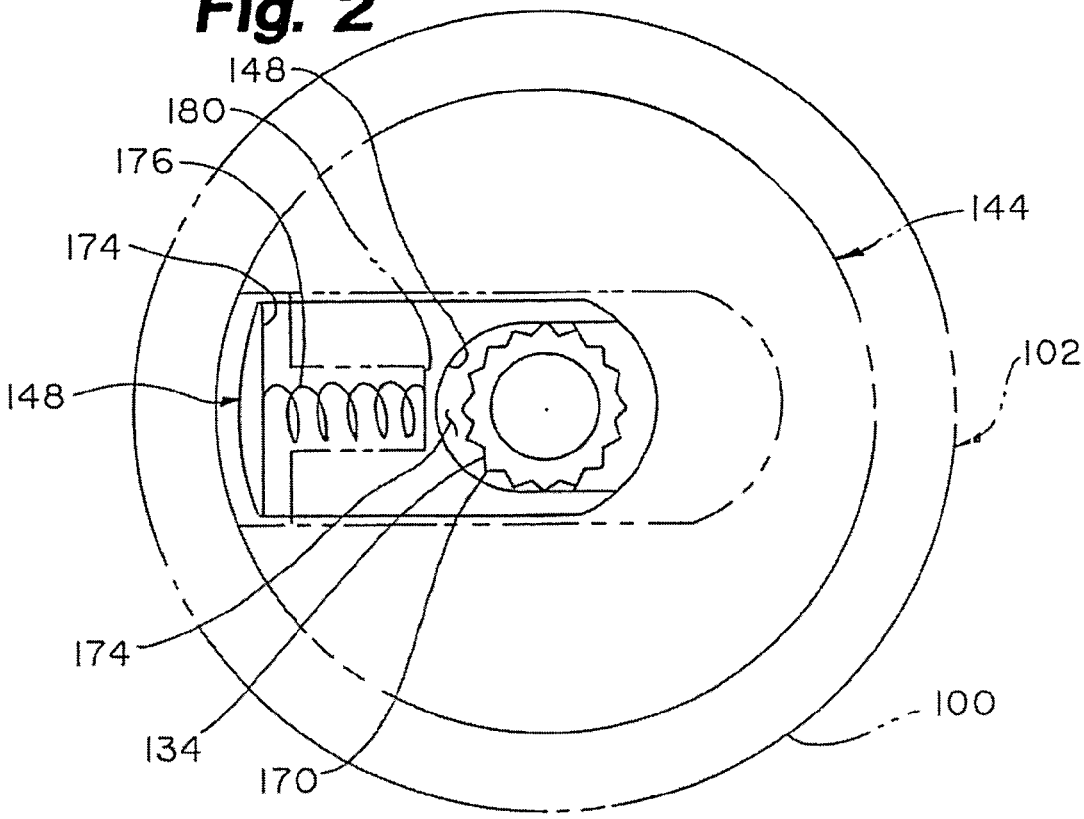
FIG. 2 is an enlarged plan view of the punch set assembly of FIG. 1.

FIG. 2 is an enlarged plan view of punch set assembly 100 of FIG. 1. In FIG. 2 it may be appreciated that lock shaft 134 includes a plurality of teeth 170. In FIG. 2, it may also be appreciated that lock key 148 includes an opening 174 adapted to receive lock shaft 134. Lock key 148 is preferably moveable between a first position in which lock key 148 engages lock shaft 134 and a second position in which lock key disengages lock shaft 134. In the embodiment of FIG. 2, lock key 148 is shown in the first position.

Adjustable length punch assembly 102 of punch set assembly 100 preferably includes a mechanism for biasing lock key 148 toward the first position. In the embodiment of FIG. 2, adjustable length punch assembly 102 includes a spring 176 having a first end seated against a first seating surface 178 of lock key 148 and a second end seated against a second seating surface 180 of drive cap 144 of drive body assembly 126. Spring 176 preferably urges lock key 148 toward the first position.

Figure 3:
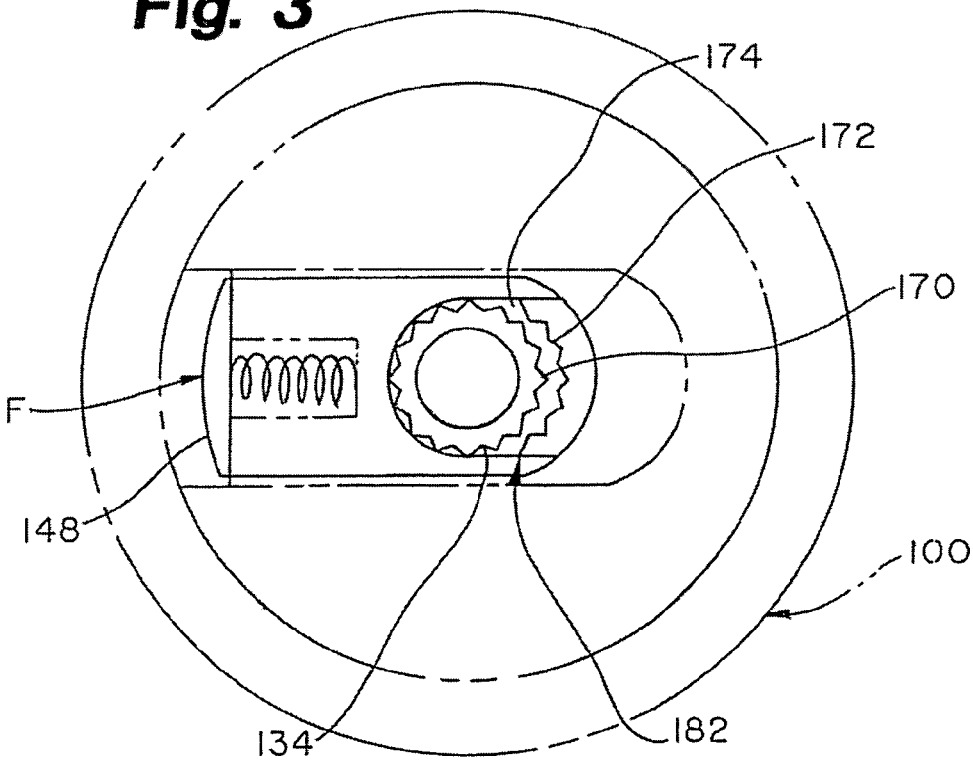
FIG. 3 is an additional enlarged plan view of the punch set assembly of FIG. 1 and FIG. 2.

FIG. 3 is an additional enlarged plan view of punch set assembly 100 of FIG. 1 and FIG. 2. As described previously, lock key 148 is preferably moveable between a first position in which lock key 148 engages lock shaft 134 and a second position in which lock key 148 disengages lock shaft 134. In the embodiment of FIG. 3, a force F is shown acting on lock key 148 and urging it into the second position.

In FIG. 3, it may be appreciated that opening 174 of lock key 148 is defined in part by a shaft engaging portion 182 of lock key 148. In the embodiment of FIG. 3, shaft engaging portion 182 of lock key 148 includes a plurality of mating teeth 172. Mating teeth 172 are preferably configured to intermesh with teeth 170 of lock shaft 134. It is to be appreciated that other embodiments of shaft engaging portion 182 are possible without deviating from the spirit and scope of the present invention.

Figure 4:
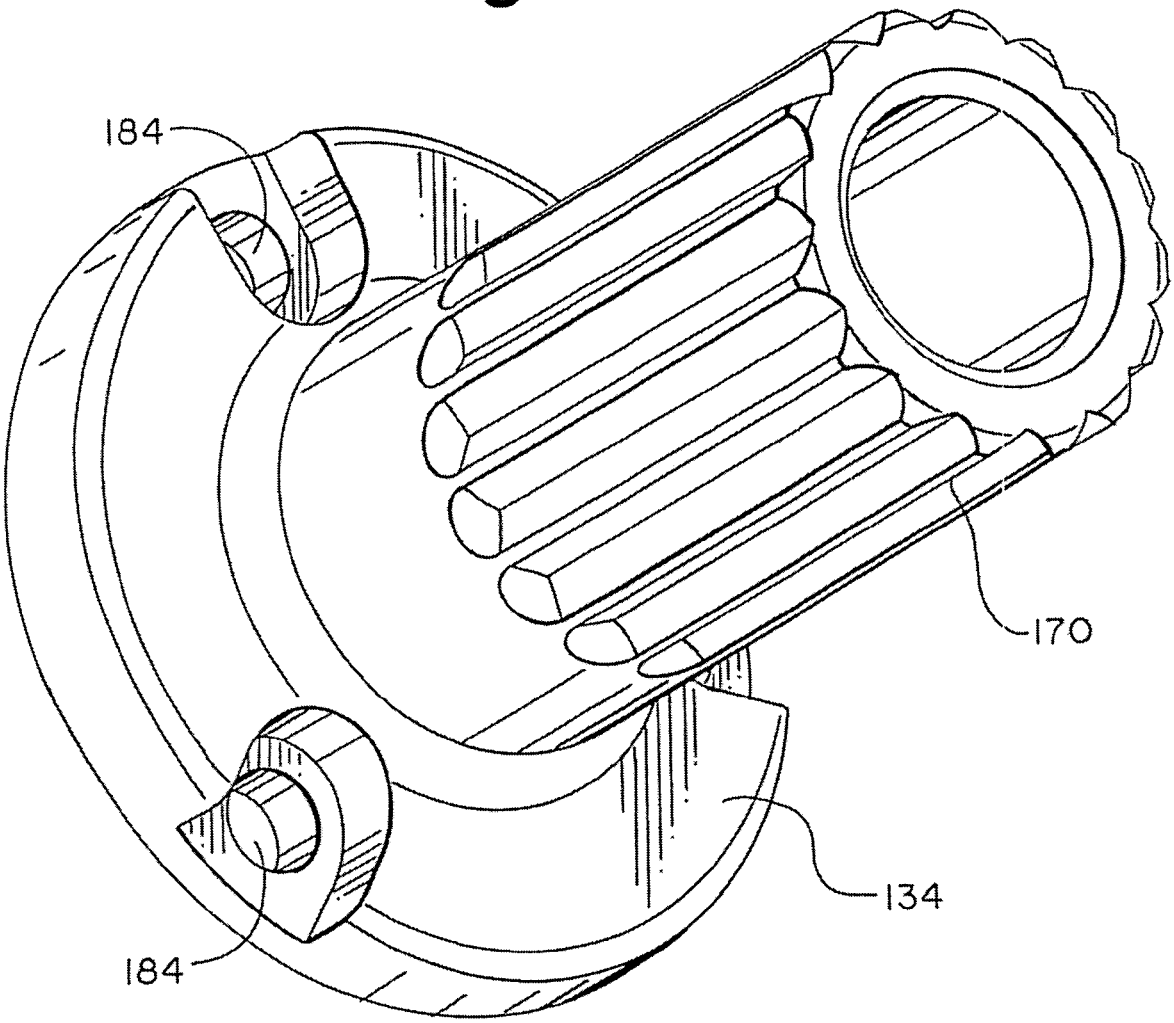
FIG. 4 is a perspective view of the lock shaft of the adjustable length punch assembly of FIG. 1, FIG. 2, and FIG. 3.

FIG. 4 is a perspective view of lock shaft 134 of adjustable length punch assembly 102. In FIG. 4, it may be appreciated that lock shaft 134 includes a plurality of holes 184. Holes 184 are preferably adapted to accept screws, pins, or other fasteners for attaching lock shaft 134 to male threaded member 132 of punch body assembly 124. Teeth 170 of lock shaft 134 are also shown in FIG. 4.

Figure 5:
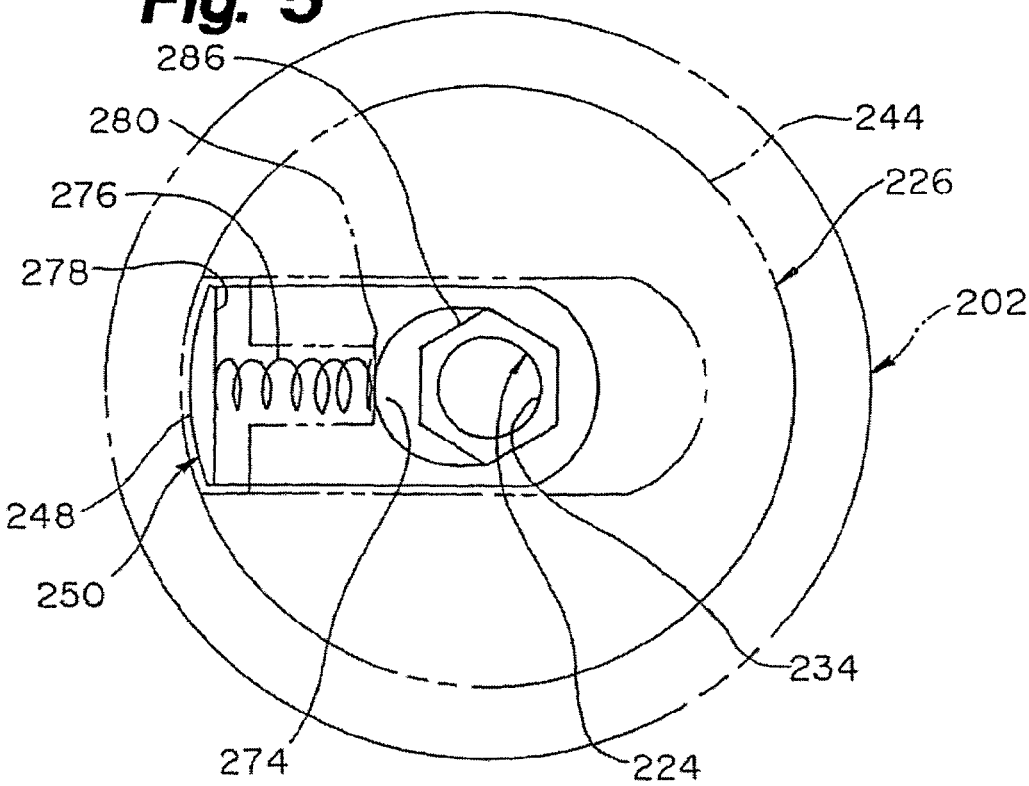
FIG. 5 is a plan view of an adjustable length punch assembly in accordance with an additional embodiment of the present invention.

FIG. 5 is a plan view of an adjustable length punch assembly 202 in accordance with an additional embodiment of the present invention. Adjustable length punch assembly 202 of FIG. 5 comprises a drive body assembly 226 including a drive cap 244 and punch body assembly 224 including a lock shaft 234. Lock shaft 234 of punch body assembly 224 has a plurality of flats 286. As in the previous embodiment, punch body assembly 224 is preferably disposed in threading engagement with a drive body assembly 226. The length of adjustable length punch assembly 202 may be adjusted by rotating of punch body assembly 224 and drive body assembly 226 relative to one another.

In the embodiment of FIG. 5, lock shaft 234 of punch body assembly 224 and a lock key 248 form part of a lock mechanism 250 for selectively preventing rotation of punch body assembly 224 relative to drive body assembly 226. Lock key 248 slidingly engages drive cap 244 of drive body assembly 226 such that lock key 248 slides along a lock key path. In FIG. 5 it may be appreciated that lock key 248 includes an opening 274 adapted to receive lock shaft 234. Lock key 248 is preferably moveable between a first position in which lock key 248 engages lock shaft 234 and a second position in which lock key disengages lock shaft 234. In the embodiment of FIG. 5, lock key 248 is shown in the first position.

Adjustable length punch assembly 202 preferably includes a mechanism for biasing lock key 248 toward the first position. In the embodiment of FIG. 5, adjustable length punch assembly 202 includes a spring 276 having a first end seated against a first seating surface 278 of lock key 248 and a second end seated against a second seating surface 280 of drive cap 244 of drive body assembly 226.

Figure 6:
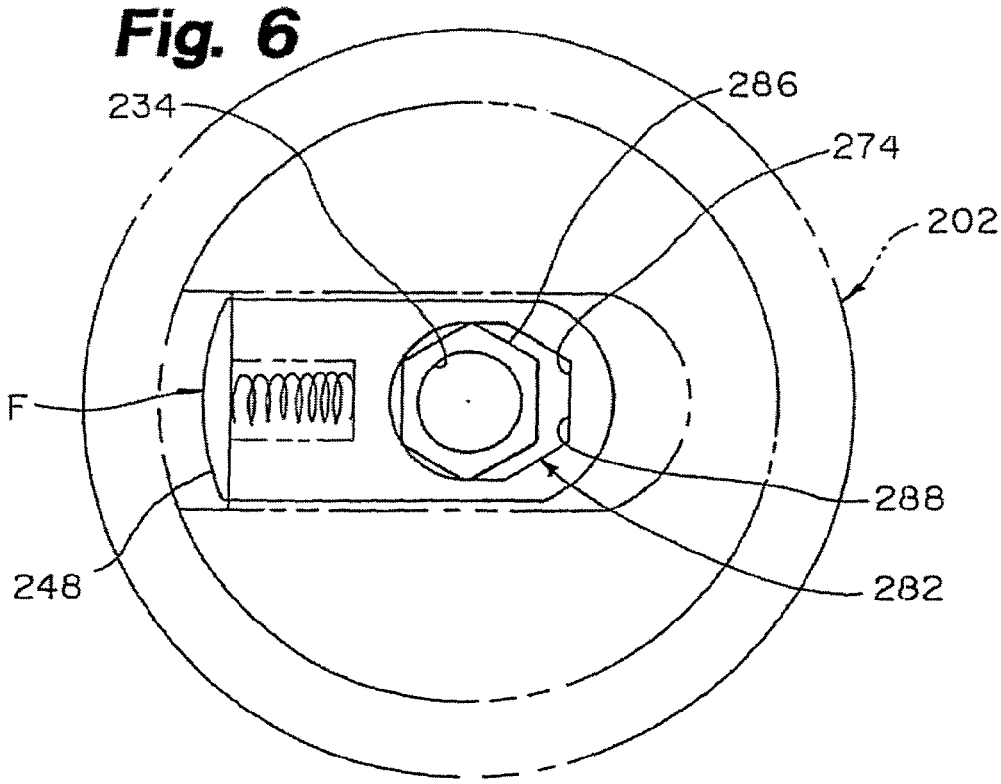
FIG. 6 is an additional plan view of the adjustable length punch assembly of FIG. 5.

FIG. 6 is an additional enlarged plan view of adjustable length punch assembly 202 of FIG. 5. As described previously, lock key 248 is preferably moveable between a first position in which lock key 248 engages lock shaft 234 and a second position in which lock key disengages lock shaft 234. In the embodiment of FIG. 6, a force F is shown acting on lock key 248 and urging it into the second position.

In FIG. 6, it may be appreciated that opening 274 of lock key 248 is defined in part by a shaft engaging portion 282 of lock key 248. In the embodiment of FIG. 5, shaft engaging portion 282 of lock key 248 includes a plurality of mating flats 288. Also in the embodiment of FIG. 5, mating flats 288 are substantially similar in size and shape to flats 286 of lock shaft 234.

Figure 7:
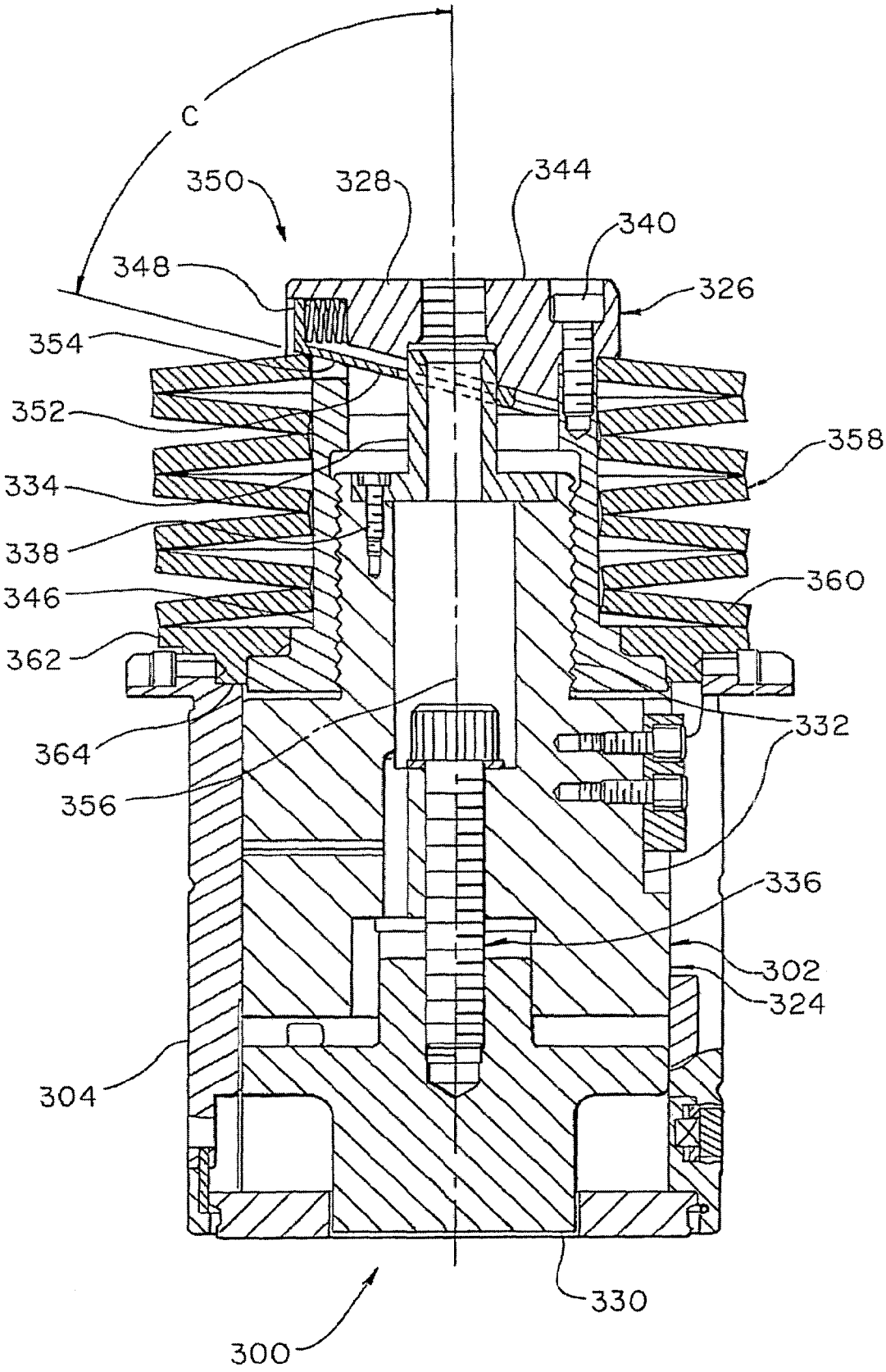
FIG. 7 is a cross sectional view of a punch set assembly in accordance with an additional exemplary embodiment of the present invention.

FIG. 7 is a cross sectional view of a punch set assembly 300 in accordance with an additional exemplary embodiment of the present invention. Punch set assembly 300 includes a sleeve 304 and an adjustable length punch assembly 302 that is slidingly disposed within sleeve 304. In the embodiment of FIG. 7, adjustable length punch assembly 302 includes a punch body assembly 324 disposed in threading engagement with a drive body assembly 326 having a striking surface 328 adapted to be struck by the ram of punch press.

Punch body assembly 324 comprises a punch blade 330, a male threaded member 332, and a lock shaft 334. As shown in FIG. 7, male threaded member 332 is attached to punch blade 330 by a relatively large cap screw 336 threaded axially into a threaded bore of punch blade 330. Also as shown in FIG. 7, lock shaft 334 is attached to male threaded member 332 with a plurality of screws 338.

Drive body assembly 326 of FIG. 7 comprises a drive cap 344 and a female threaded member 346. In the embodiment of FIG. 7, drive cap 344 is attached to female threaded member 346 by a plurality of cap screws 340, one of which is shown if FIG. 7. In FIG. 7 it may be appreciated that female threaded member 346 of drive body assembly 326 is disposed in threading contact with male threaded member 332 of punch body assembly 324.

Punch set assembly 300 also includes a spring assembly 358 comprising a plurality of belleville washers 360. A first end of spring assembly 358 is seated against drive cap 344 of drive body assembly 326. A second end of spring assembly 358 is seated against a spring support ring 362. Spring support ring 362 is in turn seated against a ledge 364 of sleeve 304.

The length of adjustable length punch assembly 302 may be adjusted by rotating punch body assembly 324 and drive body assembly 326 relative to one another. In the embodiment of FIG. 7, adjustable length punch assembly 302 includes a lock mechanism 350 for selectively preventing rotation of punch body assembly 324 relative to drive body assembly 326. Lock mechanism 350 of FIG. 7 comprises lock shaft 334 of punch body assembly 324 and a lock key 348 that slidingly engages drive cap 344 of drive body assembly 326 such that lock key 348 slides along a lock key path 352.

In the embodiment of FIG. 7, the path taken by lock key 348 is defined in part by a guiding surface 354 of drive cap 344 of drive body assembly 326. In FIG. 7 it may be appreciated that, lock key path 352 is disposed at an angle C relative to a longitudinal axis 356 of adjustable length punch assembly 302. In the embodiment of FIG. 7, angle C between lock key path 352 and longitudinal axis 356 is an acute angle.

Several forms of invention have been shown and described, and other forms will now be apparent to those skilled in art. It will be understood that embodiments shown in drawings and described above are merely for illustrative purposes, and are not intended to limit scope of invention defined claims which follow.

What is claimed is:

1. An adjustable length punch assembly for use with a punch press having a ram, comprising:

a drive body assembly having a striking surface adapted to be struck by the ram of the punch press;

a punch body assembly disposed in threading engagement with the drive body assembly such that a length of the punch assembly is adjustable in response to rotation of one of the body assemblies relative to another of the body assemblies about a longitudinal axis of the punch assembly; and a lock mechanism for selectively preventing rotation of the punch body assembly relative to the drive body assembly;

wherein the lock mechanism comprises a lock shaft, coupled to one of the body assemblies, and a lock key, slidingly coupled to the other of the body assemblies, such that the lock key moves along a lock key path;

the lock key including an opening adapted to receive the lock shaft, the opening extending about the longitudinal axis of the punch assembly and including a lock shaft engaging portion which faces toward the longitudinal axis; and the lock key path being disposed at an angle relative to the longitudinal axis of the punch assembly.

2. The adjustable length punch assembly of claim 1, wherein the angle between the lock key path and the longitudinal axis of the punch assembly is a right angle.

3. The adjustable length punch assembly of claim 1, wherein the angle between the lock key path and the longitudinal axis of the punch body assembly is an acute angle.

4. The adjustable length punch assembly of claim 1, wherein the lock key is moveable between a first position, in which the lock key engages the lock shaft, and a second position, in which the lock key disengages the lock shaft.

5. The adjustable length punch assembly of claim 4, further including a mechanism for biasing the lock key toward the first position.

6. The adjustable length punch assembly of claim 5, wherein the mechanism for biasing the lock key toward the first position comprises a spring having a first end seated against lock key and a second end seated against the one of the body assemblies.

7. The adjustable length punch assembly of claim 1, wherein the shaft engaging portion of the lock key includes at least one tooth.

8. The adjustable length punch assembly of claim 1, wherein the shaft engaging portion of the lock key includes at least one fiat.

9. The adjustable length punch assembly of claim 1, wherein the lock shaft includes at least one tooth.

10. The adjustable length punch assembly of claim 1, wherein the lock shaft includes at least one flat.

11. The adjustable length punch assembly of claim 1, wherein:

the lock shaft includes a plurality of teeth; and the shaft engaging portion of the lock key includes a plurality of teeth extending about the perimeter thereof to mate with the plurality of teeth of the lock shaft.

12. The adjustable length punch assembly of claim 1, wherein the opening extends entirely about the longitudinal axis.

13. The adjustable length punch assembly of claim 1, wherein the lock key further includes a force receiving portion, and the shaft engaging portion of the lock key engages the lock shaft on an opposite side of the longitudinal axis of the punch assembly from the force receiving portion of the lock key.

* * * * *